US009160085B2

(12) United States Patent
Jun

(10) Patent No.: US 9,160,085 B2
(45) Date of Patent: Oct. 13, 2015

(54) ELECTRICAL CONNECTOR AND A CONNECTOR ASSEMBLY

(71) Applicant: SCHNEIDER ELECTRIC INDUSTRIES SAS, Rueil-Malmaison (FR)

(72) Inventor: Pan Yi Jun, Singapore (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 108 days.

(21) Appl. No.: 14/016,576

(22) Filed: Sep. 3, 2013

(65) Prior Publication Data

US 2014/0065892 A1 Mar. 6, 2014

(30) Foreign Application Priority Data

Sep. 5, 2012 (SG) ..... 201206594-2

(51) Int. Cl.
*H01R 11/09* (2006.01)
*H01R 4/48* (2006.01)
*H01R 9/24* (2006.01)

(52) U.S. Cl.
CPC ..... *H01R 11/09* (2013.01); *H01R 4/4827* (2013.01); *H01R 9/24* (2013.01)

(58) Field of Classification Search
CPC .... H01R 4/4818; H01R 11/09; H01R 13/187; H01R 31/02; H01R 31/08; H01R 4/22; H01R 4/4845; H01R 13/111; H01R 13/113; H01R 13/115; H01R 2103/00; H01R 31/085; H01R 4/4827; H01R 11/22; H01R 13/114; H01R 13/50; H01R 25/003
USPC ..... 439/787, 439, 441, 440
See application file for complete search history.

(56) References Cited

U.S. PATENT DOCUMENTS 5,494,456 A * 2/1996 Kozel et al. ..... 439/441
5,685,735 A 11/1997 Hohorst (Continued)

FOREIGN PATENT DOCUMENTS

| | | | |
|---|---|---|---|
| CN | 101005163 | A | 7/2007 |
| CN | 101771201 | A | 7/2010 |
| DE | 202 05 821 | U1 | 8/2003 |
| DE | 10 2008 025432 | A1 | 9/2009 |
| EP | 1 798 819 | A2 | 6/2007 |

OTHER PUBLICATIONS

International Search Report and Written Opinon from corresponding Singapore Application No. 201206594-2 dated Jun. 11, 2014.

(Continued)

*Primary Examiner* — Abdullah Riyami
*Assistant Examiner* — Nelson R Burgos-Guntin
(74) *Attorney, Agent, or Firm* — Lando & Anastasi LLP

(57) ABSTRACT

A connector assembly and an electrical connector for electrically coupling at least two electrical conductors is provided whereby the connector assembly comprises a support structure wall separating the assembly into a first and a second portion; a conductive wall for providing electrical connectivity between the first and second portions; a first biasing member disposed in the first portion, the first biasing member being adapted to deflect upon a first electrical conductor being inserted into the first portion, the first biasing member being further adapted to bias the first electrical conductor against the conductive wall; and a second biasing member disposed in the second portion, the second biasing member being adapted to deflect upon a second electrical conductor being inserted into the second portion, the second biasing member being further adapted to bias the second electrical conductor against the conductive wall to electrical couple the first and the second electrical conductors.

28 Claims, 17 Drawing Sheets

(56) References Cited

U.S. PATENT DOCUMENTS

| | | | | |
|---|---|---|---|---|
| 7,785,134 | B2 * | 8/2010 | Dhandapani et al. | 439/441 |
| 2003/0171041 | A1 | 9/2003 | Blaha | |
| 2003/0194918 | A1 | 10/2003 | Fricke et al. | |
| 2007/0093121 | A1 | 4/2007 | Helmreich | |
| 2007/0141910 | A1 | 6/2007 | Camino et al. | |

OTHER PUBLICATIONS

Extended European Search Report from corresponding European Application 13182783.4 dated Oct. 7, 2013.

Chinese Search Report from corresponding Chinese Patent Application No. 201310399910.7 dated May 6, 2015.

* cited by examiner

ELECTRICAL CONNECTOR AND A CONNECTOR ASSEMBLY

CROSS-REFERENCE TO RELATED APPLICATION

This application claims the benefit under 35 U.S.C. §119 of Singapore Patent Application No. 201206594-2 filed on Sep. 5, 2012 which is hereby incorporated herein by reference in its entirety for all purposes.

TECHNICAL FIELD

The present invention relates broadly to an electrical connector and to a connector assembly.

BACKGROUND

In the electronic industries, an electrical connector typically comprises a hollow housing, an opening of the housing for introduction of a conductor, a metal contact mounted in the hollow housing adjacent to the opening, a spring means mounted in the hollow housing for biasing the conductor (inserted through the opening), into electrical contact, with the metal contact. Another opening of the housing is typically provided for introduction of a tool to affect the spring means to aid in the removal of the conductor from the hollow housing. Such a connector is typically called a semi-toolless clamp connector.

In some of such connectors, two conductors may be introduced. In such cases, two spring means are used whereby these two spring means are manufactured directly adjacent each other as one integral part for ease of assembly into the housing. This causes a problem wherein a deflection in one spring means affects the other spring means and may cause the other spring means to deflect which can compromise the electrical contact between the relevant conductor and the other spring means.

In addition, due to manufacturing considerations, a single main wall is typically provided to hold the two spring means. The main wall is typically provided on one side with the two spring means adjacent each other so as to facilitate alignment of the spring means with the openings of the housing. A rib/stopper may be provided extending from the main wall to urge the spring means to its original form in a biasing manner. This can give rise to a problem whereby the rib portion further from the main wall typically suffers from structural weakness and fails to adequately perform the biasing function. The spring means further from the main wall may then be overbent during insertion of the conductor, and thus may not engage the conductor securely. Further, the structural weakness may lead to the spring means being deformed such that it does not return to its form and may not be reusable.

In addition, there is typically no means for fixing the metal contact and/or the spring means securely or at a correct position in the hollow housing. This can result in an electrical connector that is not accurately assembled or has an internal assembly that is loose that causes malfunction during use. Furthermore, the instability of the internal assembly is made worse as the main wall is typically provided on one side. Thus, during insertion of conductors, the spring means are typically unbalanced in the housing.

Further, as the spring means are typically provided side by side as an integral part, another problem can arise in that electrical conductors may, upon insertion into openings, cross into adjacent voids. This can lead to difficulty in removal of the electrical conductors using a tool.

In view of the above, there exists a need for an electrical connector and to a connector assembly that seeks to address at least one of the problems above.

SUMMARY

In accordance with a first aspect of the present invention, there is provided a connector assembly for electrically coupling at least two electrical conductors, the assembly comprising a support structure wall separating the assembly into a first and a second portion; a conductive wall for providing electrical connectivity between the first and second portions; a first biasing member disposed in the first portion, the first biasing member being adapted to deflect upon a first electrical conductor being inserted into the first portion, the first biasing member being further adapted to bias the first electrical conductor against the conductive wall; and a second biasing member disposed in the second portion, the second biasing member being adapted to deflect upon a second electrical conductor being inserted into the second portion, the second biasing member being further adapted to bias the second electrical conductor against the conductive wall to electrical couple the first and the second electrical conductors.

The connector assembly may further comprise a first connector element and a second connector element, the first and second connector elements being separate from each other, and wherein the first connector element may comprise the first biasing member and the second connector element may comprise the second biasing member.

The first connector element may comprise a first side wall and the second connector element may comprise a second side wall, further wherein the support structure wall may be comprised of the first and second side walls being adjacent each other.

The first connector element may also comprise a first guide end wall and the second connector element may also comprise a second guide end wall, further wherein the conductive wall may comprise guide means for interacting with the first and second guide end walls to couple the first connector element and the second connector element to the conductive wall.

The first connector element may further comprise a first opening provided within the first side wall and a second opening provided within the second side wall, further wherein the first and second connector elements are capable of being coupled together via the first and second openings.

The first and second connector elements may be mirror images of each other.

The first biasing member and the second biasing member may each be adapted to reverse the biasing of the respective electrical conductors against the conductive wall, said reversing being based on interaction with a tool.

The connector assembly may further comprise a first limiting means and a second limiting means, wherein the first and second limiting means each extend from the support structure wall for limiting deflection of the respective first and second biasing members.

The connector assembly may further comprise a first stopping means and a second stopping means, wherein the first and second limiting means each extend from the support structure wall and are disposed within the connector assembly to indicate over-insertion of the respective first and second electrical conductors.

The conductive wall may be disposed substantially perpendicular to the support structure wall.

The first and second biasing members may each be disposed adjacent to opposing sides of the support structure wall.

The first and second biasing members may be adapted to deflect upon contact of the respective first and second electrical conductors being inserted into the respective first and second portions.

The first and second portions may be substantially symmetrical.

In accordance with a second aspect of the present invention, there is provided an electrical connector for electrically coupling at least two electrical conductors, the electrical connector may comprise a housing; a connector assembly for assembling within the housing, the connector assembly may comprise a support structure wall separating the assembly into a first and a second portion; a conductive wall for providing electrical connectivity between the first and second portions; a first biasing member disposed in the first portion, the first biasing member being adapted to deflect upon a first electrical conductor being inserted into the first portion, the first biasing member being further adapted to bias the first electrical conductor against the conductive wall; and a second biasing member disposed in the second portion, the second biasing member being adapted to deflect upon a second electrical conductor being inserted into the second portion, the second biasing member being further adapted to bias the second electrical conductor against the conductive wall to electrical couple the first and the second electrical conductors.

The connector assembly may further comprise a first connector element and a second connector element, the first and second connector elements being separate from each other, and wherein the first connector element may comprise the first biasing member and the second connector element may comprise the second biasing member.

The first and second connector elements may be mirror images of each other.

The housing may comprise at least two insertion openings, whereby the first biasing member and the second biasing member are each aligned to an insertion opening for receiving the respective first and second electrical conductors.

The housing may also comprise a tool opening, further wherein the first biasing member and the second biasing member are each adapted to reverse the biasing of the respective electrical conductors against the conductive wall, said reversing being based on interaction with a tool received through the tool opening.

The housing may further comprise a post coupled to a wall of the housing, wherein the post is capable of coupling the connector assembly to the housing.

The housing may further comprise a compartment wall to define an interior shape of the housing to substantially correspond to the shape of the connector assembly.

In accordance with a third aspect of the present invention, there is provided a connector element for coupling to a conductive wall of a connector assembly, the connector element may comprise a side wall for separating the assembly into a first and a second portion; a biasing member adjacent to the side wall and disposed in one of the first and second portions, the biasing member being adapted to deflect upon an electrical conductor being inserted into said one portion, the biasing member being further adapted to bias the electrical conductor against the conductive wall; further wherein the connector element is capable of cooperating with another separate connector element having another biasing member to form the connector assembly.

The connector element may further comprise a first guide end wall for interacting with guide means of the conductive wall to couple the connector element to the conductive wall.

The connector element may further comprise a first opening provided within the side wall, further wherein the connector element is capable of being coupled together to said another separate connector element via the first opening.

The biasing member may be further adapted to reverse the biasing of the respective electrical conductor against the conductive wall, said reversing being based on interaction with a tool.

The connector element may further comprise a first limiting means extending from the side wall for limiting deflection of the biasing member.

The connector element may further comprise a first stopping means extending from the side wall for indicating over-insertion of the respective electrical conductor.

The biasing member may be adapted to deflect upon contact of the respective electrical conductor being inserted into said one portion.

Another separate connector element may be a mirror image of the connector element.

In accordance with a fourth aspect of the present invention, there is provided a method of forming a connector assembly. The method may comprise providing a conductive wall for providing electrical connectivity; providing two or more connector elements, each may comprise, a side wall; a biasing member adjacent to the side wall; forming a support structure wall using at least one side wall of the connector elements, said support structure wall separating the conductive wall into a first and a second portion; disposing a first biasing member of a first connector element in the first portion, the first biasing member being adapted to deflect upon a first electrical conductor being inserted into the first portion, the first biasing member being further adapted to bias the first electrical conductor against the conductive wall; and disposing a second biasing member of a second connector element in the second portion, the second biasing member being adapted to deflect upon a second electrical conductor being inserted into the second portion, the second biasing member being further adapted to bias the second electrical conductor against the conductive wall to electrical couple the first and the second electrical conductors.

The method may further comprise coupling the two or more connector elements to the conductive wall.

BRIEF DESCRIPTION OF THE DRAWINGS

Example embodiments of the invention will be better understood and readily apparent to one of ordinary skill in the art from the following written description, by way of example only, and in conjunction with the drawings, in which:

FIG. 1(*b*) is a front view of the connector assembly of FIG. 1(*a*).

FIG. 1(*c*) is a back view of the connector assembly of FIG. 1(*a*).

FIG. 1(*d*) is a top view of the connector assembly of FIG. 1(*a*).

FIG. 1(*e*) is a bottom view of the connector assembly of FIG. 1(*a*).

FIG. 1(*f*) is a side view of the connector assembly of FIG. 1(*a*).

FIG. 2(*b*) is a front view of the conductive contact of FIG. 2(*a*).

FIG. 2(*c*) is a back view of the conductive contact of FIG. 2(*a*).

FIG. 2(*d*) is a top view of the conductive contact of FIG. 2(*a*).

FIG. 2(*e*) is a bottom view of the conductive contact of FIG. 2(*a*).

FIG. 2(*f*) is a side view of the conductive contact of FIG. 2(*a*).

FIG. 3(*b*) is a front view of the first connector element of FIG. 3(*a*).

FIG. 3(*c*) is a back view of the first connector element of FIG. 3(*a*).

FIG. 3(*d*) is a top view of the first connector element of FIG. 3(*a*).

FIG. 3(*e*) is a bottom view of the first connector element of FIG. 3(*a*).

FIG. 3(*f*) is a side view of the first connector element of FIG. 3(*a*).

FIG. 4(*b*) is a front view of the second connector element in of FIG. 4(*a*).

FIG. 4(*c*) is a back view of the second connector element in of FIG. 4(*a*).

FIG. 4(*d*) is a top view of the second connector element in of FIG. 4(*a*).

FIG. 4(*e*) is a bottom view of the second connector element in of FIG. 4(*a*).

FIG. 4(*f*) is a side view of the second connector element in of FIG. 4(*a*).

DETAILED DESCRIPTION

Figure 1A:
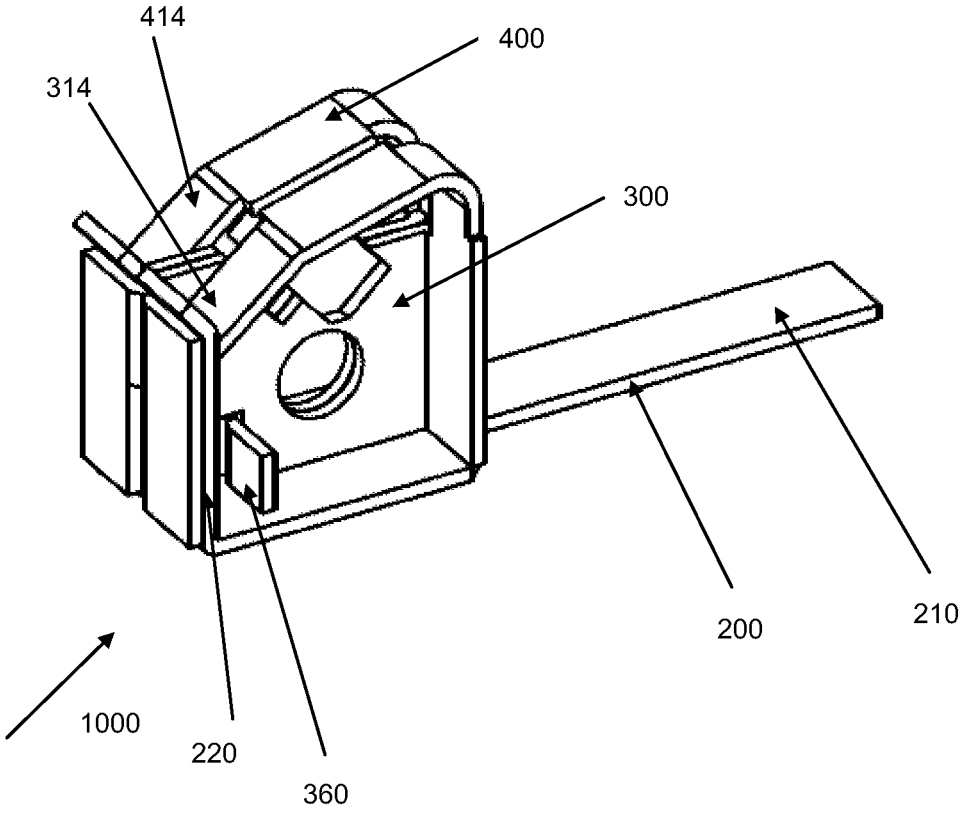
FIG. 1(*a*) is a perspective view of a connector assembly in an example embodiment.
Figure 1B:
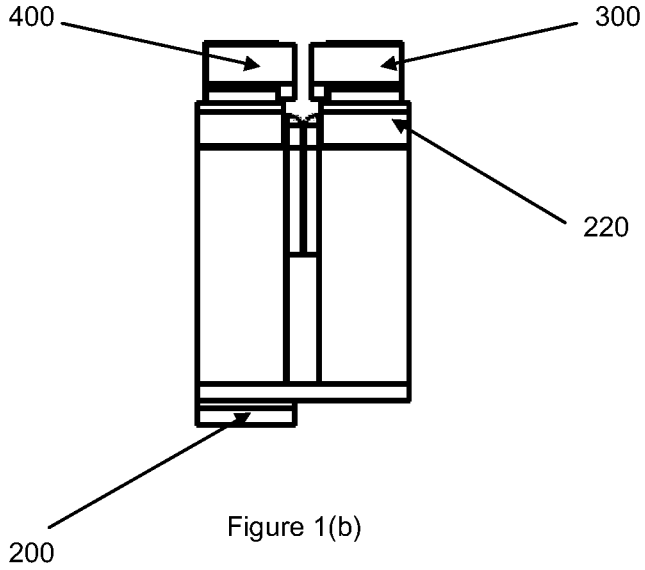
Figure 1C:
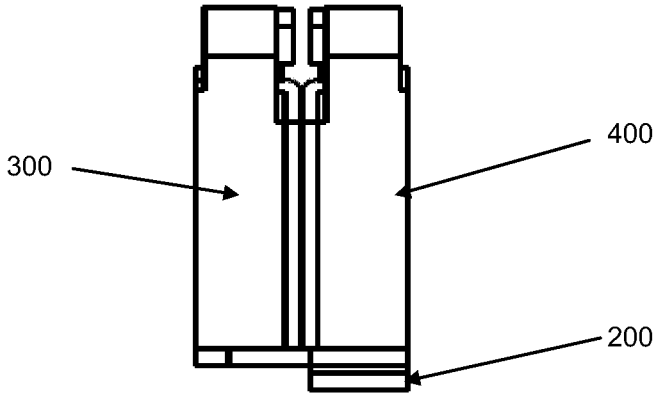
Figure 1D:
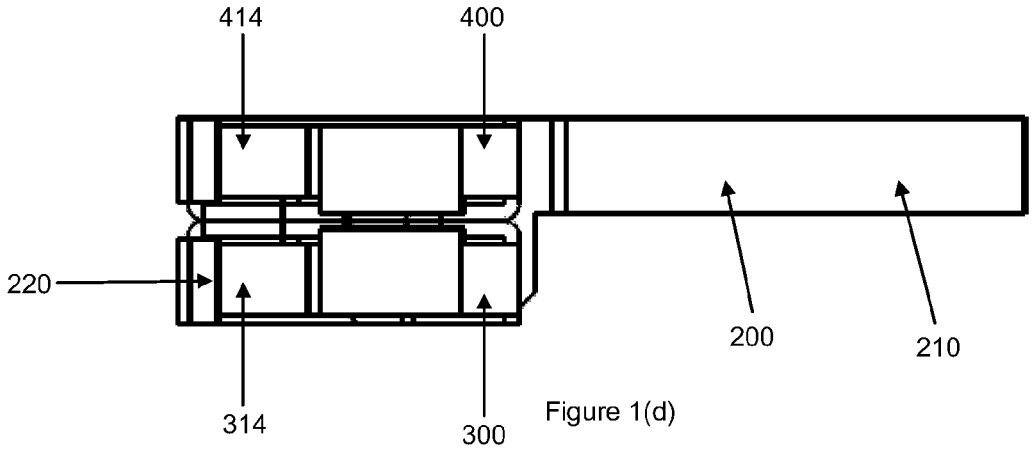
Figure 1E:
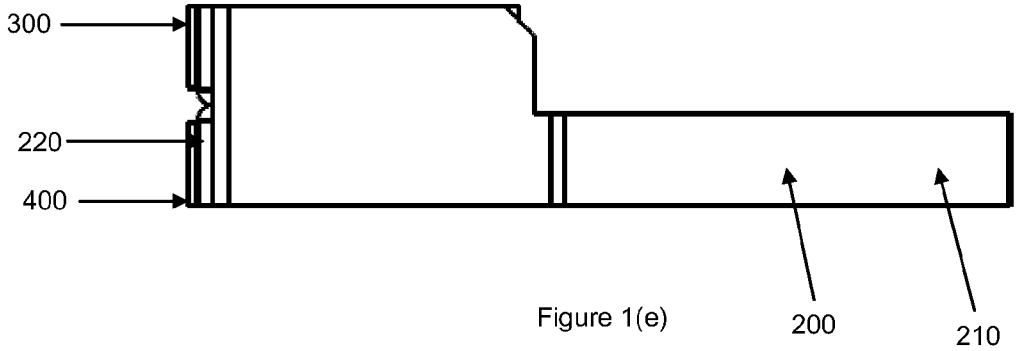
Figure 1F:
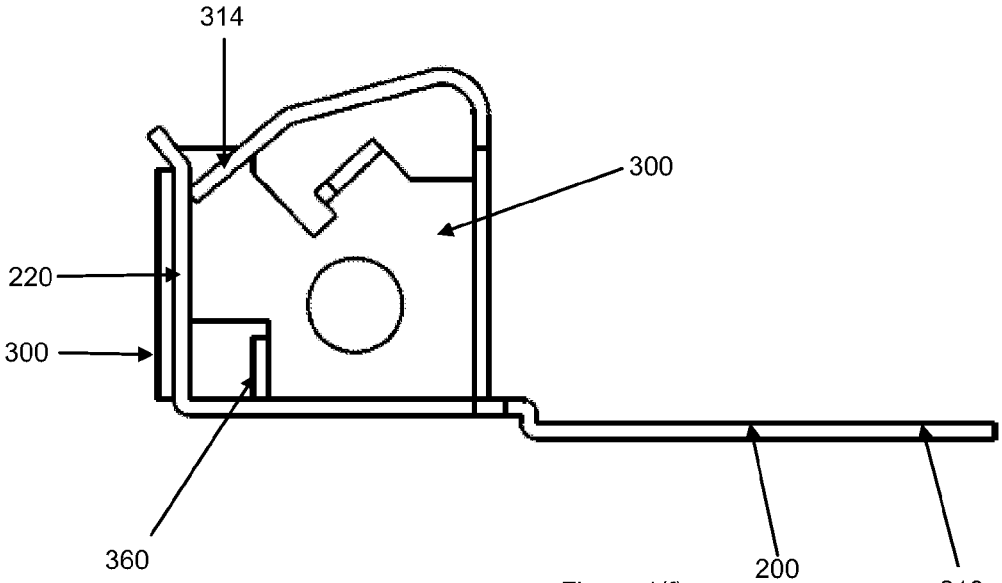
Figure 2A:
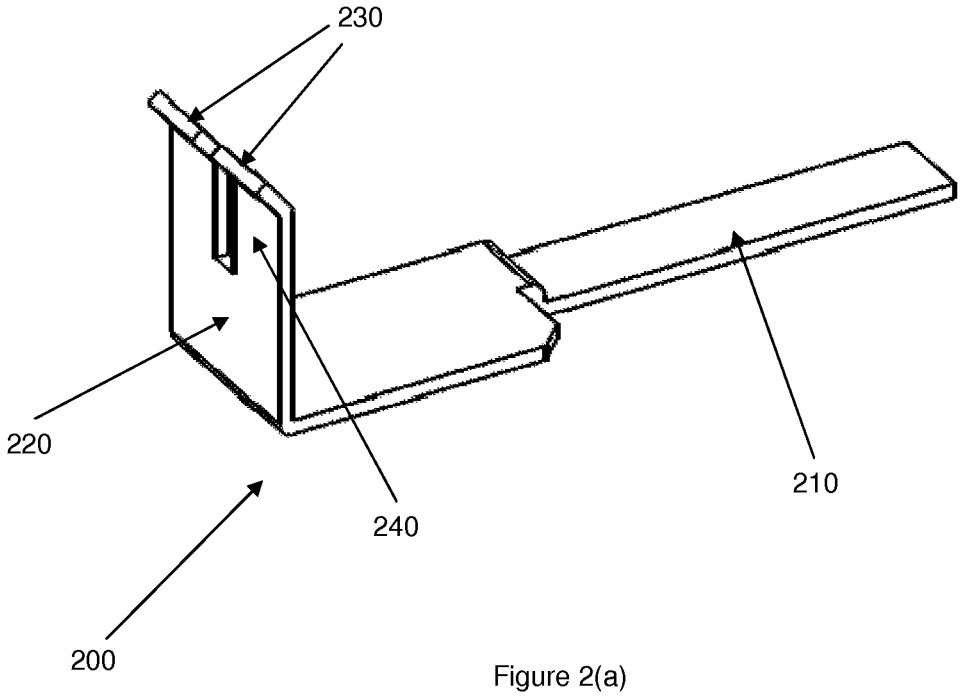
FIG. 2(*a*) is a perspective view of a conductive contact in an example embodiment.
Figure 2B:
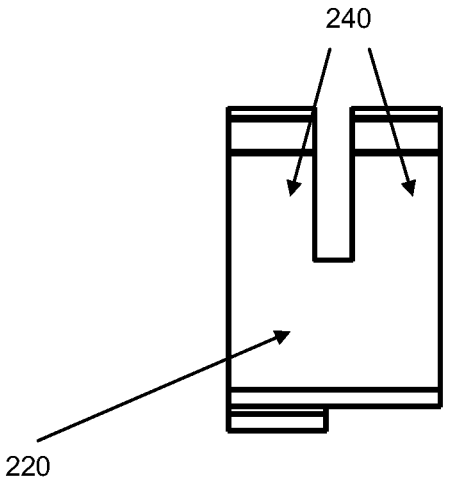
Figure 2C:
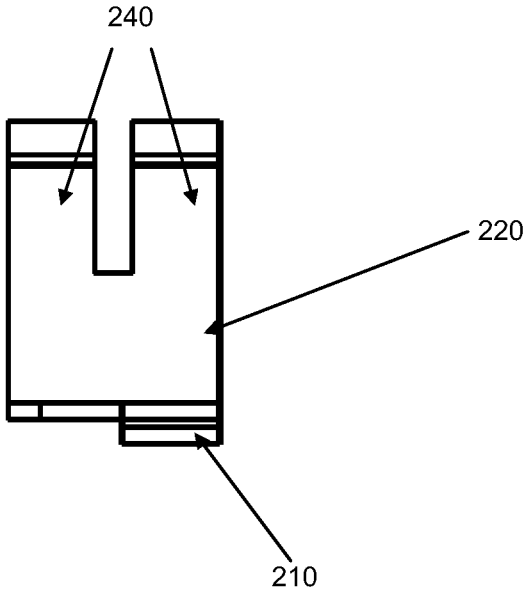
Figure 2D:
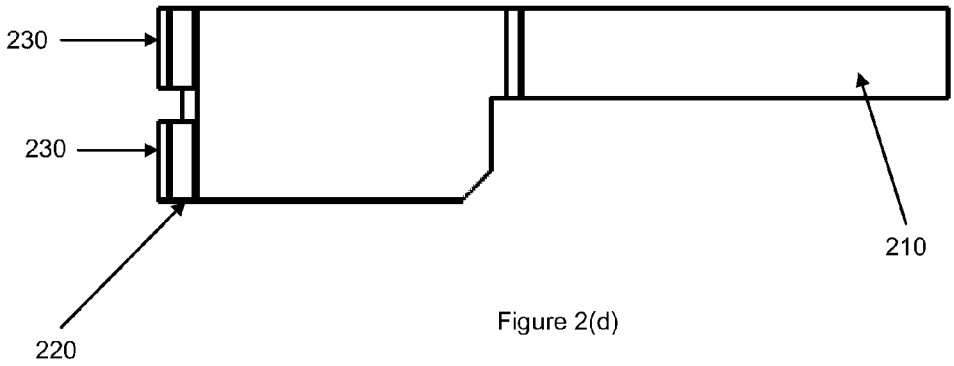
Figure 2E:
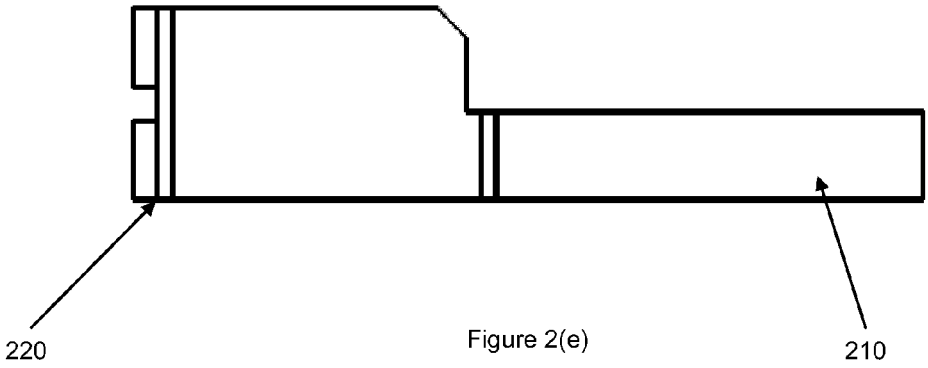
Figure 2F:
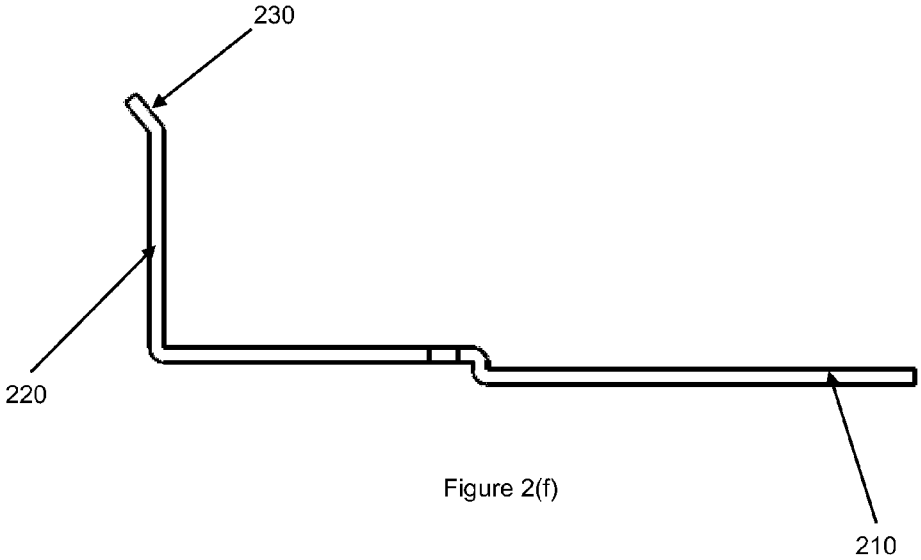
Figure 3A:
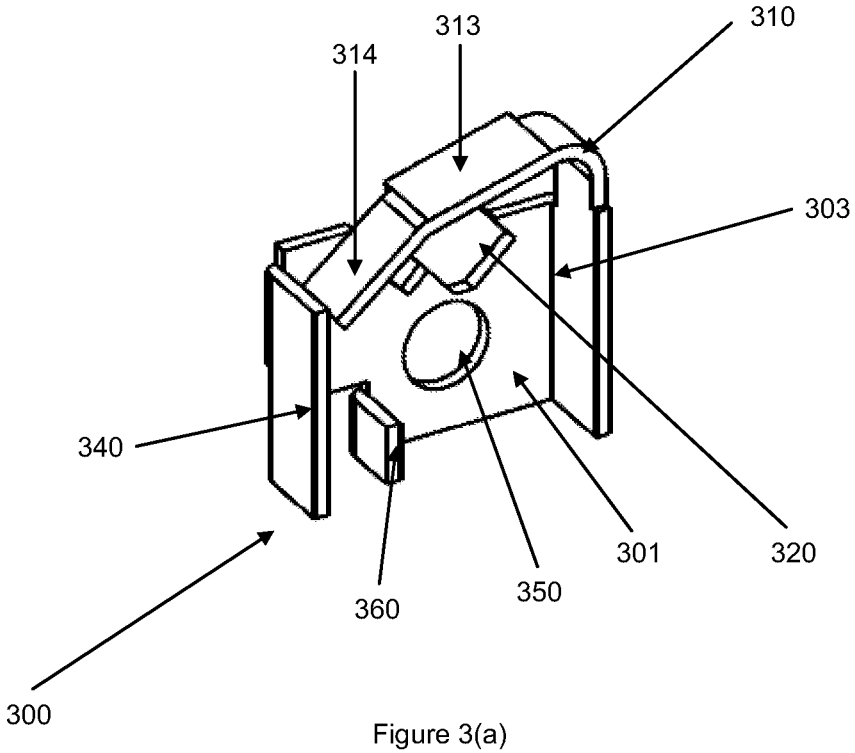
FIG. 3(*a*) is a perspective view of a first connector element in an example embodiment.
Figure 3B:
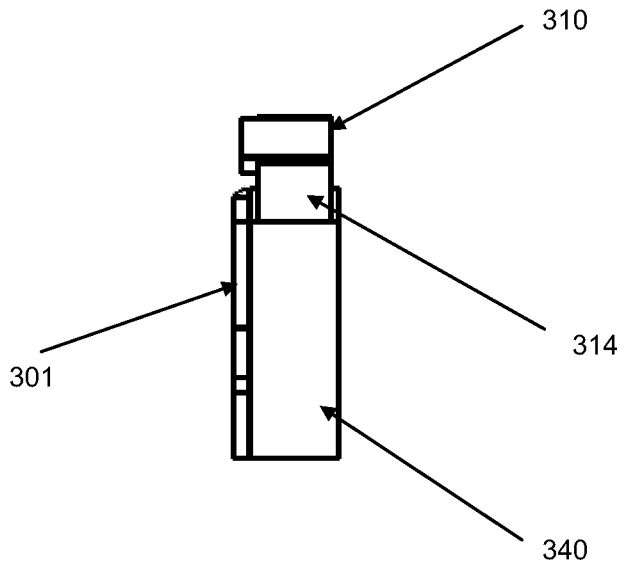
Figure 3C:
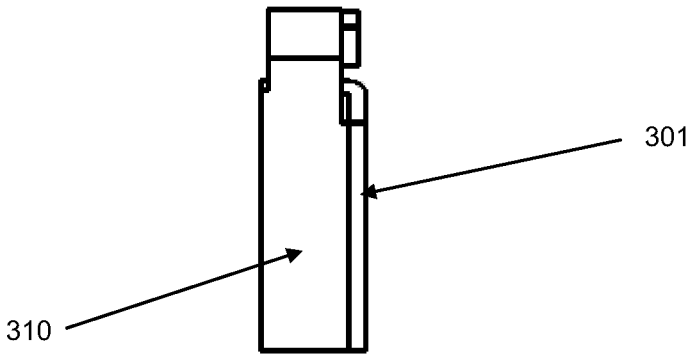
Figure 3D:
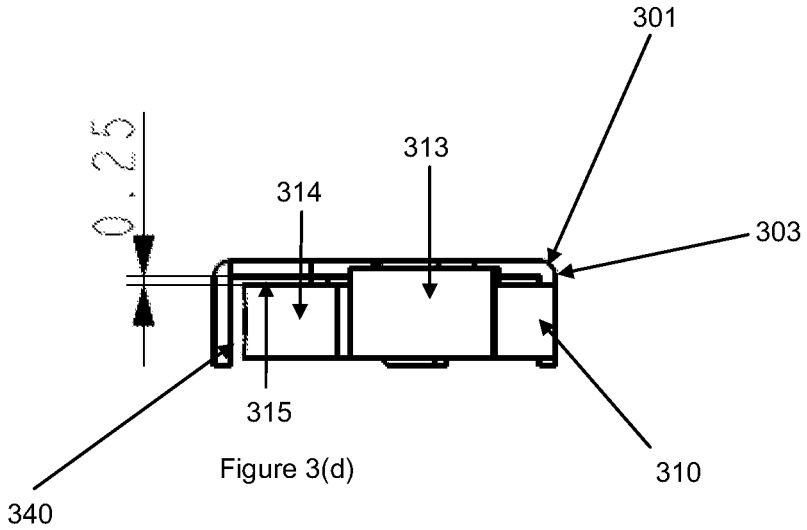
Figure 3E:
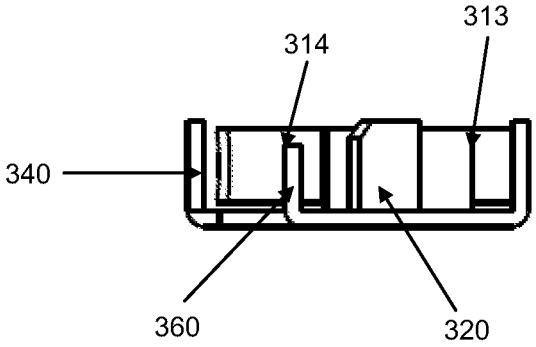
Figure 3F:
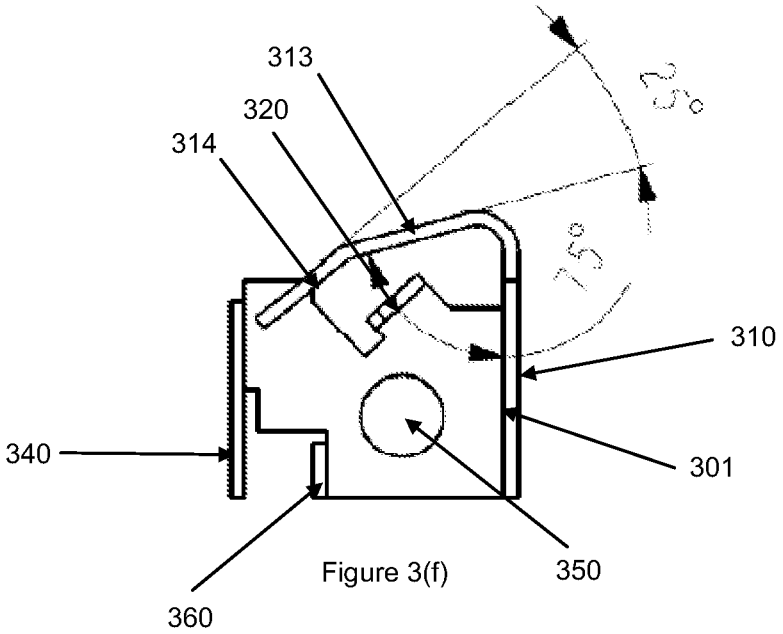
Figure 4A:
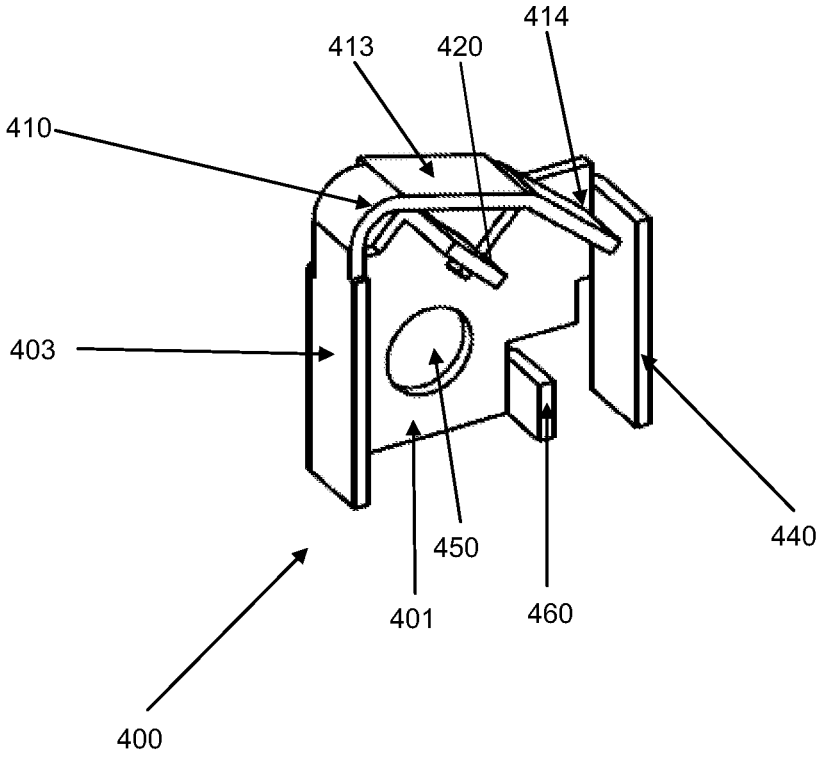
FIG. 4(*a*) is a perspective view of a second connector element in an example embodiment.
Figure 4B:
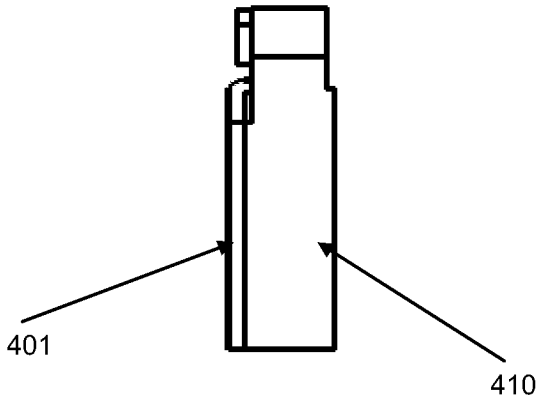
Figure 4C:
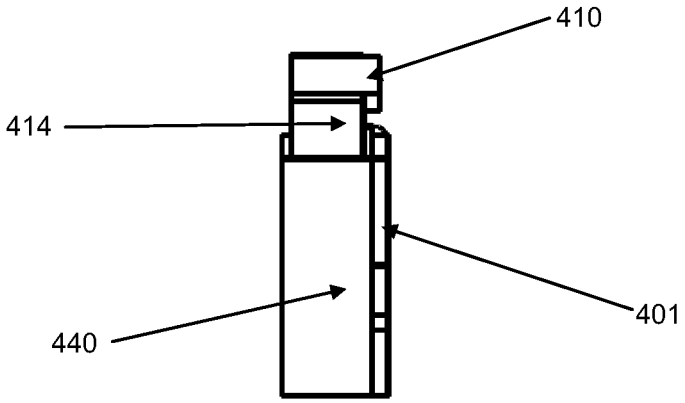
Figure 4D:
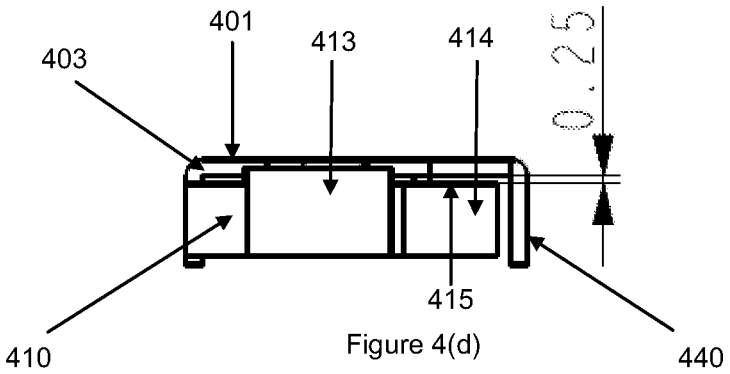
Figure 4E:
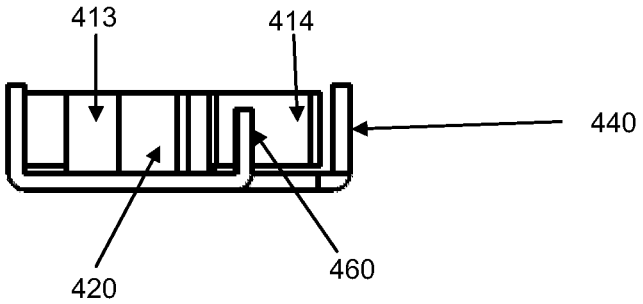
Figure 4F:
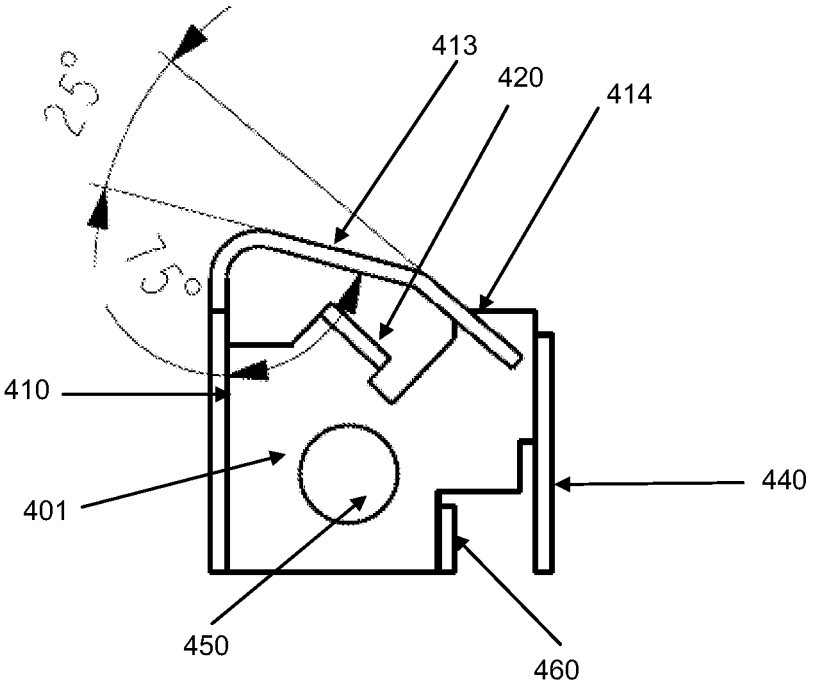

The terms "coupled" or "connected" as used in this description are intended to cover both directly connected or connected through one or more intermediate means, unless otherwise stated.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

In the example embodiments described below, an electrical connector can comprise a housing enclosing an inner connector assembly. The electrical connector can serve to electrically connect one or more electrical conductors (e.g. wires) using a conducting (such as metal) contact. The connected electrical conductors can then be further electrically connected to a device elsewhere using the contact.

FIG. 1(*a*) is a perspective view of a connector assembly 1000 in an example embodiment. The assembly 1000 comprises a conductive contact 200, a first connector element 300 and a second connector element 400 coupled together.

FIG. 2(*a*) is a perspective view of a conductive contact 200 in an example embodiment. FIGS. 2(*b*), (*c*), (*d*), (*e*) and (*f*) are front view, back view, top view, bottom view and side view drawings respectively of the conductive contact 200 in FIG. 2(*a*). These figures are included for better illustration. In the example embodiment, the contact is preferably metal. The contact 200 comprises a first linear portion 210 and a second linear portion 220. In the example embodiment, the second linear portion 220 functions as a conductive wall when assembled in a connector assembly. The metal contact 200 may be generally L-shaped with the second linear portion 220 being substantially perpendicular to the first linear portion 210. The top part 230 of the second linear portion 220 may end at a pre-determined angle such that the contact 200 may better engage with the complementary shape of a housing (compare 100 below) to provide a more secure fit when the contact 200 is assembled with the housing. The metal contact 200 may be made of any conductive metal, such as, but not limited to, brass. The metal contact 200 further comprises guide means 240. The guide means 240 are used to engage and clip/secure the first connector element 300 and the second connector element 400 to the metal contact 200. The metal contact may be termed a blade. The guide means 240 may be slots formed in the second linear portion 220.

FIG. 3(*a*) is a perspective view of a first connector element 300 in an example embodiment. FIGS. 3(*b*), (*c*), (*d*), (*e*) and (*f*) are front view, back view, top view, bottom view and side view drawings respectively of the first connector element 300 of FIG. 3(*a*). These figures are included for better illustration. The first connector element 300 may be termed a spring clamp. In the example embodiment, the first connector element 300 comprises a first vertical side wall 301, a first biasing member such as spring means 310, a first limiting means 320 for limiting deflection (or overbending) of the first spring means 310. The first limiting means 320 may be termed a deflecting rib, preferably a metal deflecting rib. The first spring means 310 may be integrally connected to one end wall 303 of the first vertical side wall 301.

In the example embodiment, the distance between an edge 315 of the first spring means 310 and the first vertical side wall 301 is, for example, but not limited to, about 0.25 mm.

The first limiting means 320 is disposed under the first spring means 310. In the example embodiment, the limiting means 320 extend from the first vertical side wall 301. The first limiting means 320 limits the deflection of the first spring means 310 when a force is exerted on the first spring means 310. When a force is exerted on the first spring means 310, further deflection is limited when the first spring means 310 comes into contact with the first limiting means 320.

The first connector element 300 further comprises a guide end wall 340 connected to the side wall 301, the guide end wall 340 being opposite to the end wall 303.

The first connector element 300 also comprises a stopping means 360 for limiting over-insertion of an electrical conductor. The stopping means 360 is disposed at a periphery of the first vertical side wall 301 and opposite the end wall 303. The stopping means 360 may be termed a stopping rib, more preferably a metal stopping rib. The first connector element 300 further comprises a first opening 350 on the first vertical side wall 301.

In the example embodiment, the first spring means 310 is preferably connected to the end wall 303 at an acute angle, for example, but not limited to, about 75°.

The first spring means 310 comprises a first portion 313 and a second portion 314. The first portion 313 is preferably joined to the second portion 314 at an obtuse angle, for example, but not limited to, about 155°. Thus, with the angular arrangement, it is relatively more difficult to deflect the first portion 313 as compared to the second portion 314. Therefore, deflection of the first spring means 310 is made lesser at the first portion 313 than at the second portion 314.

FIG. 4(*a*) is a perspective view of a second connector element 400 in an example embodiment. FIGS. 4(*b*), (*c*), (*d*), (*e*) and (*f*) are front view, back view, top view, bottom view and side view drawings respectively of the second connector 400 of FIG. 4(*a*). These figures are included for better illustration. The second connector element 400 may be termed a spring clamp.

In the example embodiment, the second connector element 400 is a mirror image of the first connector element 300 such that the side walls of each spring clamp can be placed together for the guide end walls 340 and 440 to be adjacent each other. That is, the second connector element 400 can co-operate with the first connector element 300 in forming the connector assembly.

In the example embodiment, the second connector element 400 comprises a second vertical side wall 401, a second biasing member such as spring means 410, a second limiting means 420 for limiting deflection (or overbending) of the second spring means 410. The second limiting means 420 may be termed a deflecting rib, preferably a metal deflecting rib. The second spring means 410 may be integrally connected to one end wall 403 of the second vertical side wall 401.

In the example embodiment, the distance between an edge 415 of the second spring means 410 and the second vertical side wall 401 is, for example, but not limited to, about 0.25 mm.

The second limiting means 420 is disposed under the second spring means 410. In the example embodiment, the limiting means 420 extend from the second vertical side wall 401. The second limiting means 420 limits the deflection of the second spring means 410 when a force is exerted on the second spring means 410. When a force is exerted on the second spring means 410, further deflection is limited when the second spring means 410 comes into contact with the second limiting means 420.

The second connector element 400 further comprises a guide end wall 440 connected to the side wall 401, the guide end wall 440 being opposite to the end wall 403.

The second connector element 400 also comprises stopping means 460 for limiting over-insertion of an electrical conductor. The stopping means 460 is disposed at a periphery of the second vertical side wall 401 and opposite the end wall 403. The stopping means 460 may be termed a stopping rib, preferably a metal stopping rib. The second connector element 400 further comprises a second opening 450 on the second vertical side wall 401.

In the example embodiment, the second spring means 410 is preferably connected to the end wall 403 at an acute angle, for example, but not limited to, about 75°.

The second spring means 410 comprises a first portion 413 and a second portion 414. The first portion 413 is preferably joined to the second portion 414 at an obtuse angle, for example, but not limited to, about 155°. Thus, with the angular arrangement, it is relatively more difficult to deflect the first portion 413 as compared to the second portion 414. Therefore, deflection of the second spring means 410 is made lesser at the first portion 413 than at the second portion 414.

In the example embodiment, the first connector element 300 and the second connector element 400 may be made of flexible metal, for example, but not limited to, stainless steel.

Returning to FIG. 1(*a*), in the example embodiment, the first connector element 300 and the second connector element 400 are each coupled to the metal contact 200 by fitting the guide end walls 340 and 440 with the complementary guide means 240 of the metal contact 200. FIGS. 1(*b*), (*c*), (*d*), (*e*) and (*f*) are front view, back view, top view, bottom view and side view drawings respectively of the connector assembly 1000 of FIG. 1(*a*). These figures are included for better illustration.

In the example embodiment, the guide end walls 340 and 440 secure the first connector element 300 and the second connector element 400 to the metal contact 200. In this arrangement, the first vertical side wall 301 of the first connector element 300 and the second vertical side wall 401 of the second connector element 400 contact and rest against each other.

Guide means 240 of the metal contact 200 are complementary to guide end wall 340 of the first connector element 300 and guide end wall 440 of the second connector element 400. Where guide means 240 are openings such as half-slots, guide end walls 340, 440 can act as stoppers for slotting a portion of the side walls 301, 401 into the slots. Alternatively, where guide end walls 340, 440 are provided with openings on the end walls such as slots, guide means 240 can be provided with extended arms that may be fitted in the openings.

In the example embodiment, after coupling, the second portions 314, 414 of the first and second connector elements 300, 400 respectively abut the second linear portion 220 of the metal contact 200. In the example embodiment, the stopping means 360 and 460 of the first and second connector elements 300, 400 respectively rest on the first linear portion 210 of the metal contact 200.

Thus, in the example embodiment, the connector assembly is separated into a first and a second chamber/portion, with the biasing members or spring means 310, 410 each being disposed in a chamber/portion. Therefore, in this configuration, two channels are formed along a length of the conductive wall (compare 220) whereby electrical conductors can be inserted and contact the spring means 310, 410.

Figure 5:
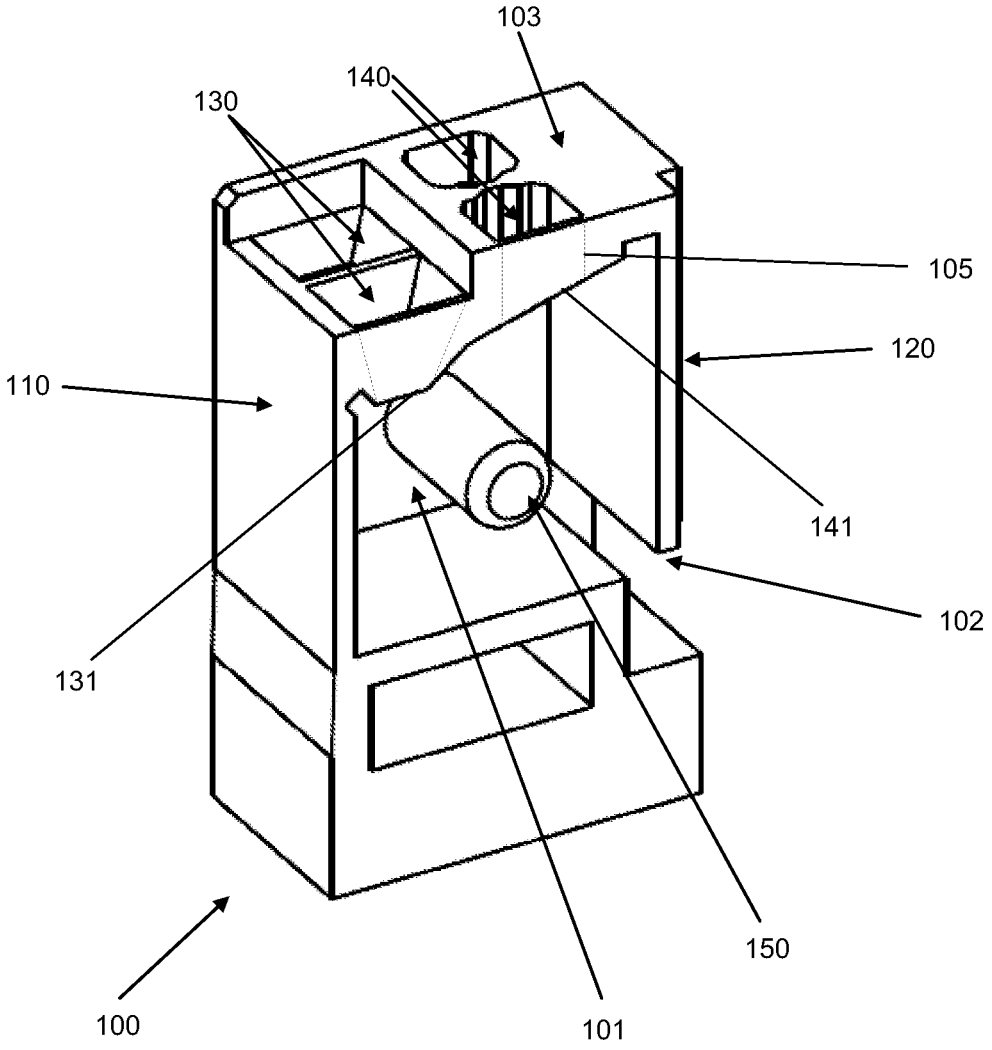
FIG. 5 is a perspective view of a housing in an example embodiment.

FIG. 5 is a perspective view of a housing 100 in an example embodiment. In the example embodiment, the housing 100 comprises a first wall 101, a first side wall 110, a second side wall 120, first openings 130 for receiving two or more electrical conductors and second openings 140 for receiving a tool. The first openings 130 and the second openings 140 are provided on a front wall 103 of the housing 100. The front wall 103 faces a user during insertion of electrical conductors into the housing 100. A gap 102 is provided along or at the end of the second wall 120 such that a portion of a conductive contact is allowed to be extended out of the housing 100 for electrical connection elsewhere (not shown).

In the example embodiment, the walls e.g. 110, 103, 120 define a interior of the housing 100. The housing 100 may further comprise a compartment wall 105 which is in a complementary shape to a connector assembly of a conductive contact, a first connector element and a second connector element (compare numeral 1000). The compartment wall 105 can ensure a more secure fit between the housing and the connector assembly. In such an example embodiment, there may be provided supplementary first openings 131 which are directly below and correspond to the first openings 130; and supplementary second openings 141 which are below and correspond to the second openings 140.

In the example embodiment where the housing 100 optionally further comprises a compartment wall 105, an electrical conductor can be inserted via a first opening e.g. 130 and further inserted into the corresponding supplementary first opening e.g. 131. A tool can be inserted via the relevant second opening e.g. 140 and through the corresponding supplementary second opening e.g. 141 to release the electrical conductor from the grip of the spring means respective to that first opening.

The housing 100 may further comprise an extended limb or post 150 which extends from the first wall 101 into the cavity or interior of the housing 100.

In the example embodiment, the housing 100 may be made of an insulating material, for example, but not limited to, plastic.

Figure 6:
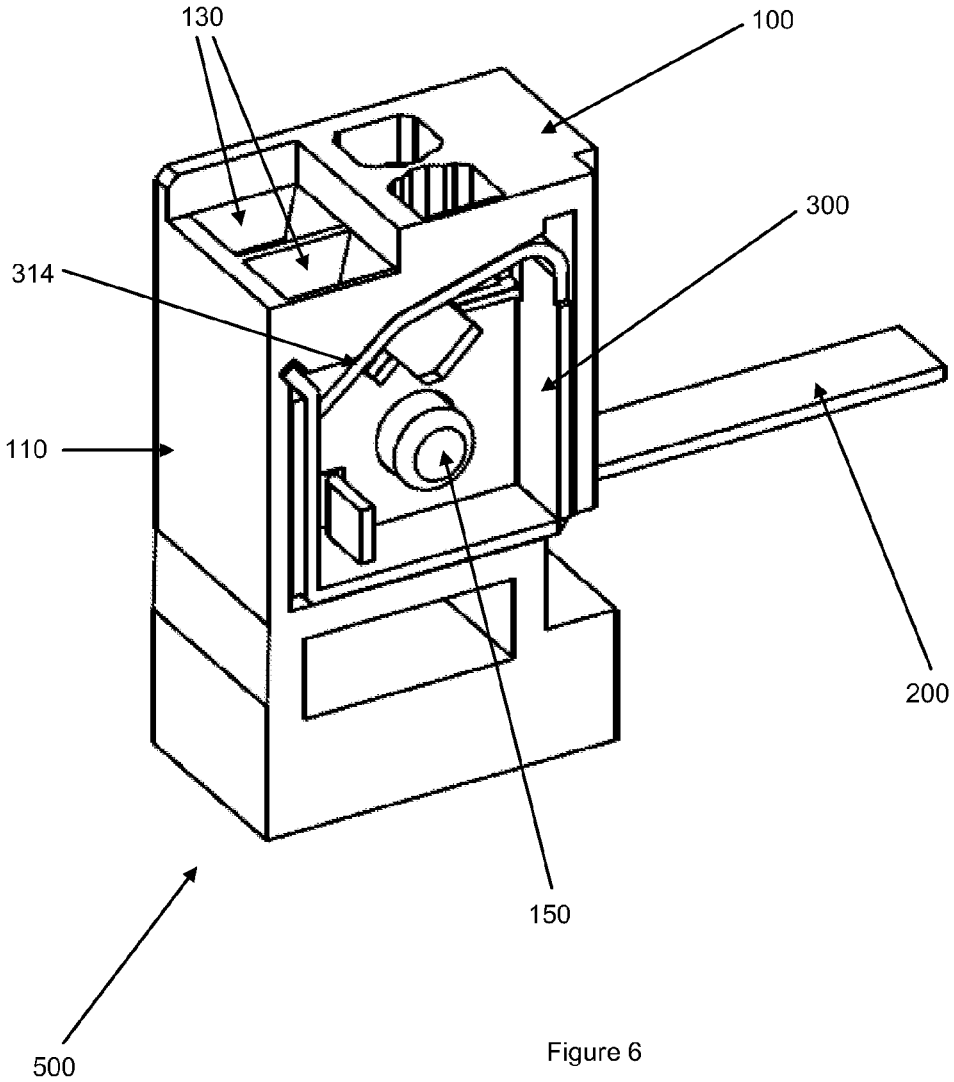
FIG. 6 is a perspective view of an electrical connector in an example embodiment.

FIG. 6 is a perspective view of an electrical connector 500 in an example embodiment. The electrical connector 500 can be used for connecting electrical conductors and a conductive contact. In the example embodiment, the electrical connector 500 comprises a housing 100, a conductive contact 200, a first connector element 300 and a second connector element 400. The various components are assembled (compare 1000) and fitted into the housing 100. In this arrangement, the external part of guide end walls 340 and 440 respectively of the first connector element 300 and the second connector element 400 abut the first side wall 110 of the housing 100. The end wall 303 of the first connector element 300 and the second end wall 403 of the second connector element 400 abut the second side wall 120 of the housing 100. The first openings 130 of the housing 100 are aligned with the second portions 314 and 414 respectively of the first connector element 300 and the second connector element 400.

In the example embodiment, the extended limb 150 of the housing 100 is complementary to both the first opening 350 of the first connector element 300 and the second opening 450 of the second connector element 400. The extended limb 150 of the housing 100, the first opening 350 of the first connector element 300 and the second opening 450 of the second connector element 400 form securing means for coupling the contact 200, the first connector element 300 and the second connector element 400 to the housing 100. The first opening 350 and the second opening 450 are fitted into and coupled to the extended limb 150. This can ensure that users are able to attach the assembly 1000 into the housing 100 at a more accurate pre-determined position to result in a tighter assembly.

In use, a user can insert an electrical conductor through each of the first openings 130 of the housing 100. For ease of explanation, only one insertion with respect to one connector element/spring clamp is described. It will be understood that the explanation applies for any of the first and second connector elements.

Figure 7:
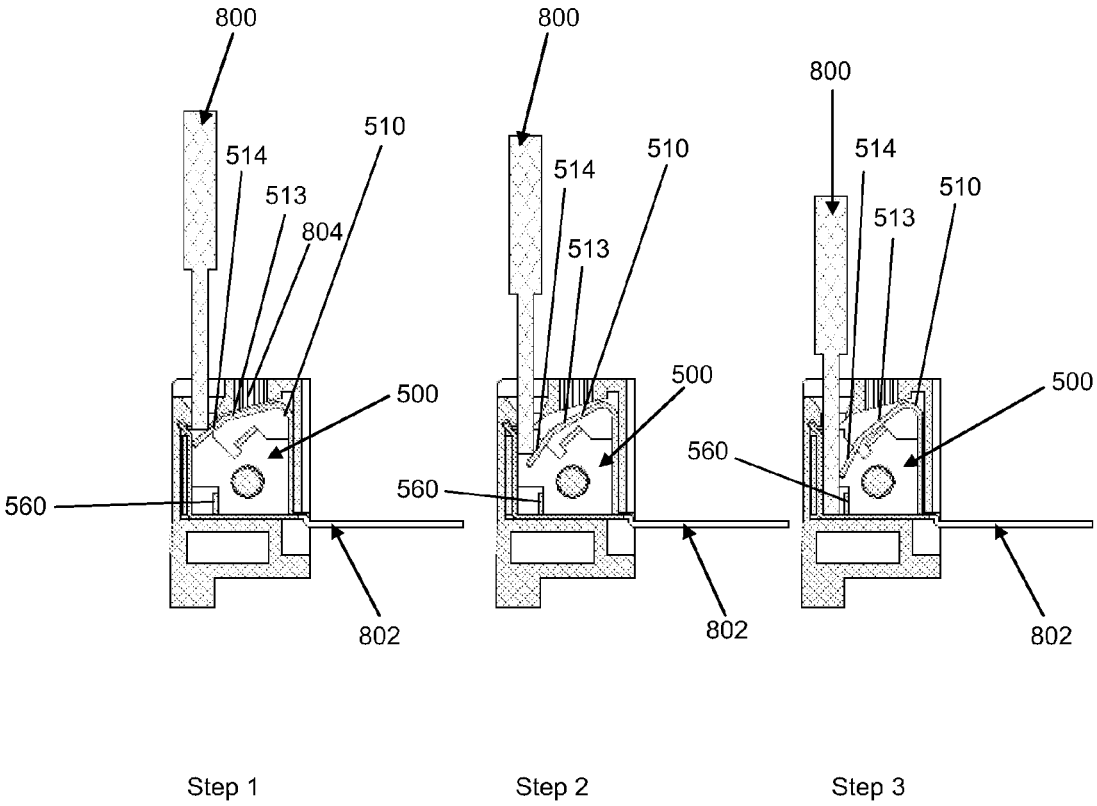
FIG. 7 is a schematic drawing for illustrating the steps of inserting an electrical conductor into an electrical connector in an example embodiment.

FIG. 7 is a schematic drawing for illustrating the steps of inserting an electrical conductor 800 into an electrical connector in an example embodiment.

Referring to FIG. 7, when an electrical conductor 800 contacts the second portion 514 (compare 314 of FIG. 3(*a*)) of the first connector element 500 (compare 300 of FIG. 3(*a*)) as shown in step 1, the force exerted by the user causes the second portion 514 (compare 314) to deflect in the same direction as the motion of the electrical conductor 800, as shown in step 2. This allows the user to continue to insert the electrical conductor 800 into the housing without the use of any tool. Thereafter, when the user no longer exerts a force on the electrical conductor 800, the second portion 514 (compare 314) functions as a resilient means to bias the electrical conductor 800 to abut against and electrically contact a contact 802 (compare 200 of FIG. 2(*a*)), as shown in step 3. The second portion 514 (compare 314), being part of the first spring means 510 (compare 310 of FIG. 3(*a*)), thus causes the electrical conductor 800 to be fixed/secured into a position against the contact 802.

With the angular arrangement of each of the spring means e.g. 510 (compare 310, 410 of FIGS. 3(*a*), 4(*a*)), it is relatively more difficult to deflect the respective first portions e.g. 513 (compare 313, 413 of FIGS. 3(*a*), 4(*a*)) as compared to the respective second portions e.g. 514 (compare 314, 414 of FIGS. 3(*a*), 4(*a*)). Therefore, if a user wrongly inserts an electrical conductor into any of the second openings e.g. 804, the electrical conductor contacts the respective first portion e.g. 513 (compare 313, 413). As the first portions e.g. 513 (compare 313, 413) are not easily deflected, the user is prevented from further insertion of the electrical conductor. This can cause the user to realize the error in insertion and to rectify the error.

The stopping means e.g. 560 (compare 360 and 460 of FIGS. 3(*a*), 4(*a*)) of the first connector element 500 (compare 300) and the second connector element (not shown in the figure respectively can prevent a user from over-inserting electrical conductors into the housing. If an electrical conductor reaches a stopping means e.g. 560 (compare 360, 460), the conductor may no longer be inserted further without being deformed. The user can then detect that the electrical conductor is experiencing resistance against the stopping means e.g. 560 (compare 360, 460) and hence, can stop inserting the electrical conductor. That is, a tactile indication can be provided to the user that over-insertion has occurred, that is, the electrical conductor has begun proceeding in the direction of the stopping means e.g. 560 (compare 360, 460).

In the example embodiment, to remove an electrical conductor from the housing 100, a user may insert a tool, such as a pin or a screwdriver, into a respective second opening e.g. 140 of the housing 100.

Figure 8:
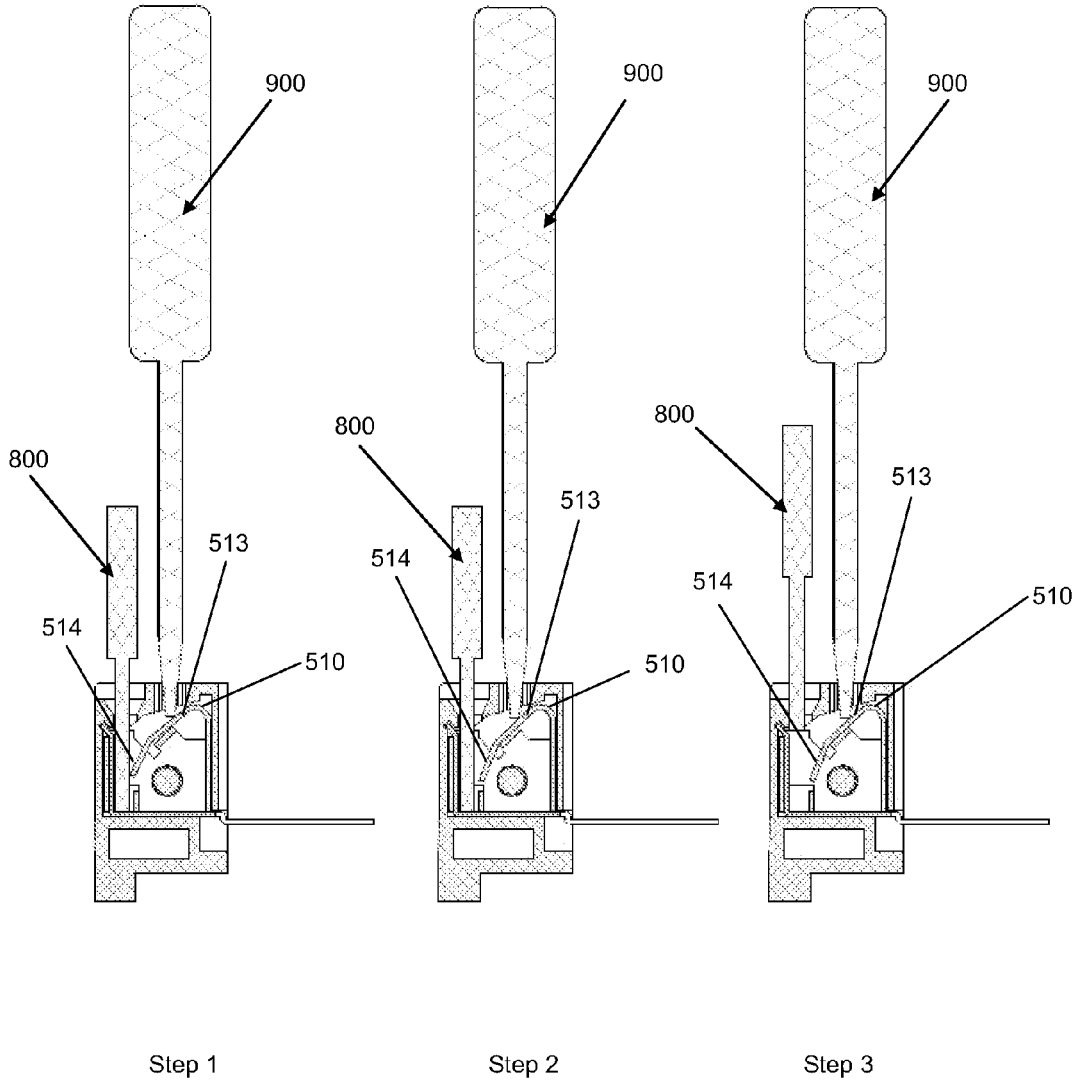
FIG. 8 is a schematic drawing for illustrating the steps of removing an electrical conductor from an electrical connector in an example embodiment.

FIG. 8 is a schematic drawing for illustrating the steps of removing an electrical conductor from an electrical connector in an example embodiment.

Referring to FIG. 8, when a tool 900 comes into contact with the respective first portion e.g. 513 (compare 313, 413 of FIGS. 3(*a*), 4(*a*)) as shown in step 1, the tool 900 can cause the first portion 513 (compare 313, 413) to deflect in the same direction of insertion. This in turn causes the electrical conductor 800 to be released from contact with the respective second portion 514 (compare 314, 414 of FIGS. 3(*a*), 4(*a*)) as shown in step 2. Hence, the electrical conductor 800 can be released from the grip of the respective spring means 510 (compare 310, 410 of FIGS. 3(*a*), 4(*a*)), and can be removed as shown in step 3.

In the described example embodiment, a main wall or support structure wall (e.g. the two side walls 301, 401 coupled together) of the connector assembly is provided in preferably substantially the middle/center of the connector assembly. That is, the connector assembly and/or the conductive wall (compare 220) is separated into two portions that are preferably symmetrical to each other. Thus, the support structure wall can advantageously provide better balance/stability and added robustness to the connector assembly. Furthermore, the main wall of the connector assembly is disposed between the respective spring means. Thus, advantageously, cross- and erroneous insertion of electrical conductors can be prevented by the main wall. This insertion reliability may be further enhanced by the close proximity of the support structure to the respective second portions 314, 414. Further, the support structure wall functioning as a separator can increase the strength of the separator.

In the described example embodiment, the conductive contact 200 is secured with guide end walls 340, 440. This can advantageously reinforce support to the conductive contact 200 that interacts with electrical conductors, and can reduce impact of material thermal degradation.

In addition, if spring means e.g. 310, 410 are provided independent to each other (e.g. in separate connector elements 300, 400), force applied on a spring means is advantageously prevented from affecting other spring means e.g. from losing contact with respective electrical conductors. Thus, connection and/or insertion of electrical conductors is made more reliable.

Furthermore, the inventors have recognized that, for cost and manufacturing issues, separate connector elements are not taught to be provided for connector assemblies in the industry. In addition, having separate connector elements can advantageously mean that damaged connector assemblies can be easily repaired by replacing the individual damaged connector elements, i.e. without discarding the entire assembly as taught in conventional connectors that have spring means integral to each other.

In addition, in the described example embodiment, the two-angular arrangement (between the spring means e.g. 310 and end wall e.g. 303; and between the first portion e.g. 313 and second portion e.g. 314) can increase wire insertion flexibility and prevent conductor insertion through openings e.g. 140 meant for a tool. For the wire insertion flexibility, by having an increased obtuse angle between the first and second portions and preferably a larger radius/distance to the guide end wall, the second portion can be made more elastic. For the prevention of conductor insertion, by having an acute angle between the spring means and the end wall, it is more difficult to deflect the first portion of the spring means.

Figure 9:
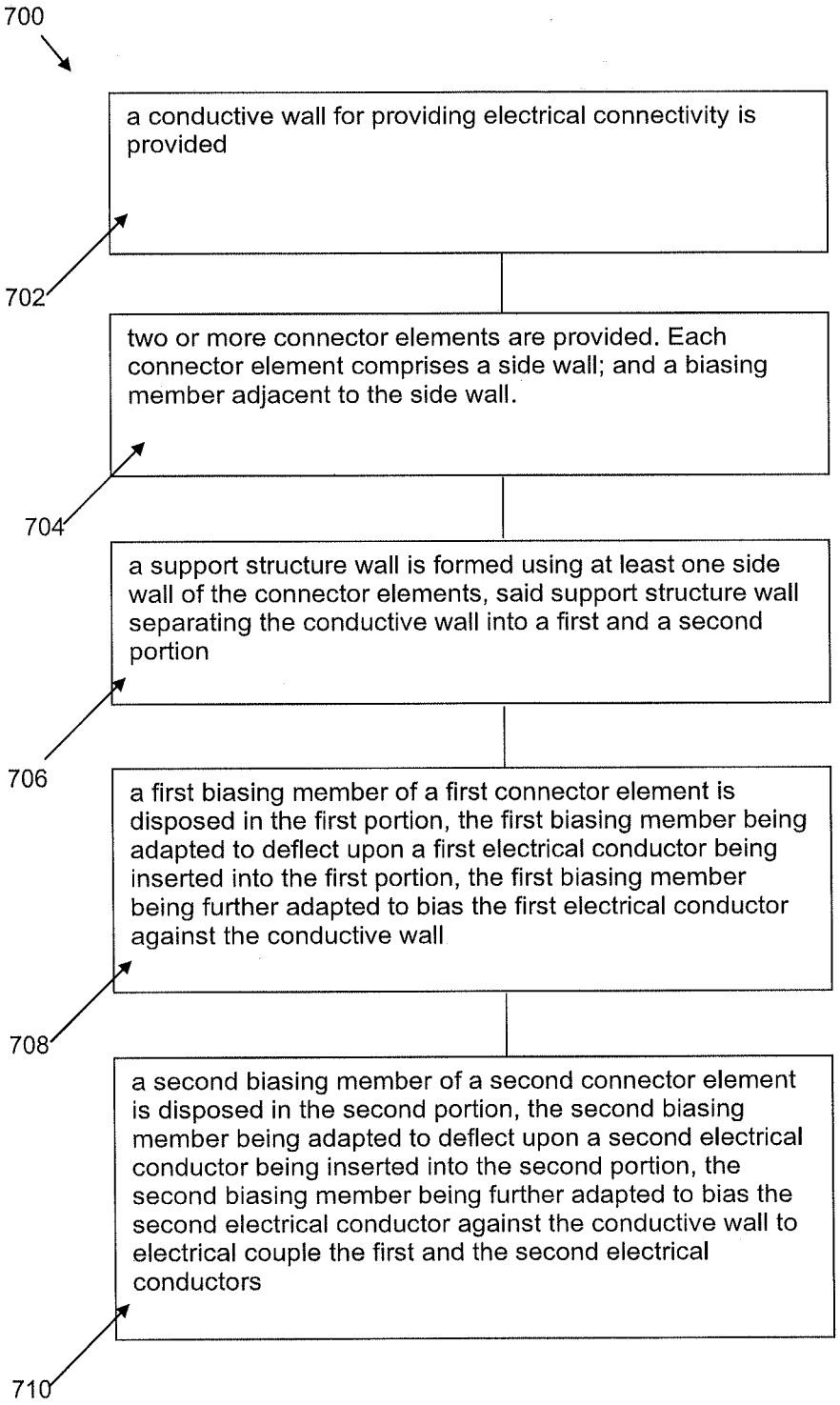
FIG. 9 is a schematic flowchart for illustrating a method of forming a connector assembly in an example embodiment.

FIG. 9 is a schematic flowchart 700 for illustrating a method of forming a connector assembly in an example embodiment. At step 702, a conductive wall for providing electrical connectivity is provided. At step 704, two or more connector elements are provided. Each connector element comprises a side wall; and a biasing member adjacent to the side wall. At step 706, a support structure wall is formed using at least one side wall of the connector elements, said support structure wall separating the conductive wall into a first and a second portion. At step 708, a first biasing member of a first connector element is disposed in the first portion, the first biasing member being adapted to deflect upon a first electrical conductor being inserted into the first portion, the first biasing member being further adapted to bias the first electrical conductor against the conductive wall. At step 710, a second biasing member of a second connector element is disposed in the second portion, the second biasing member being adapted to deflect upon a second electrical conductor being inserted into the second portion, the second biasing member being further adapted to bias the second electrical conductor against the conductive wall to electrical couple the first and the second electrical conductors.

It will be appreciated by a person skilled in the art that other variations and/or modifications may be made to the specific embodiments without departing from the spirit or scope of the invention as broadly described. The present embodiments are, therefore, to be considered in all respects to be illustrative and not restrictive.

It will be appreciated that although two separate connector elements e.g. 300, 400 have been described to make up the connector assembly, the example embodiments are not limited to such and can be modified to provide an integrally formed connector assembly. That is, an integrally formed assembly resembling numeral 1000 with a substantially central support structure with spring means adjacent the support structure on each side, and limiting means (compare 320, 420) extending on each side of the support structure, can be provided. Further, the example embodiments can also be modified to comprise even more separate connector elements.

Further, although separate connector elements e.g. 300, 400 have been described as being mirror images, it will be appreciated that the example embodiments are not limited as such and can even be formed by identical connector elements with at least a support structure provided substantially in the center of the connector assembly.

The invention claimed is:

1. A connector assembly for electrically coupling at least two electrical conductors, the assembly comprising:

a support structure wall separating the assembly into a first and a second portion;

a conductive wall for providing electrical connectivity between the first and second portions;

a first biasing member disposed in the first portion, the first biasing member being adapted to deflect upon a first electrical conductor being inserted into the first portion, and the first biasing member being further adapted to bias the first electrical conductor against the conductive wall;

a second biasing member disposed in the second portion, the second biasing member being adapted to deflect upon a second electrical conductor being inserted into the second portion, and the second biasing member being further adapted to bias the second electrical conductor against the conductive wall to electrically couple the first and the second electrical conductors;

a first connector element including a first side wall and the first biasing member; and a second connector element including a second side wall and the second biasing member, the first and second connector elements being separate from each other, and wherein the support structure wall is comprised of the first and second side walls being adjacent to each other.

2. The connector assembly of claim 1, wherein the first connector element comprises a first guide end wall and the second connector element comprises a second guide end wall, and wherein the conductive wall comprises a guide to interact with the first and second guide end walls to couple the first connector element and the second connector element to the conductive wall.

3. The connector assembly of claim 2, wherein the first connector element comprises a first opening provided within the first side wall and a second opening is provided within the second side wall, wherein the first and second connector elements are capable of being coupled together via the first and second openings.

4. The connector assembly of claim 3, wherein the first and second connector elements are mirror images of each other.

5. The connector assembly of claim 1, wherein the first biasing member and the second biasing member are each adapted to reverse the biasing of the respective electrical conductors against the conductive wall using a tool.

6. The connector assembly of claim 1, further comprising a first limiting means and a second limiting means, wherein the first and second limiting means each extend from the support structure wall for limiting deflection of the respective first and second biasing members.

7. The connector assembly of claim 1, further comprising a first stopping means and a second stopping means, wherein the first and second stopping means each extend from the support structure wall and are disposed within the connector assembly to indicate over-insertion of the respective first and second electrical conductors.

8. The connector assembly of claim 1, further comprising the conductive wall being disposed substantially perpendicular to the support structure wall.

9. The connector assembly of claim 1, wherein the first and second biasing members are each disposed adjacent to opposing sides of the support structure wall.

10. The connector assembly of claim 1, wherein the first and second biasing members are adapted to deflect upon contact of the respective first and second electrical conductors being inserted into the respective first and second portions.

11. The connector assembly of claim 1, wherein the first and second portions are substantially symmetrical.

12. An electrical connector for electrically coupling at least two electrical conductors, the connector comprising, a housing;

a connector assembly within the housing, the connector assembly comprising, a support structure wall including a first side wall and a second side wall, the support structure wall separating the assembly into a first and a second portion;

a conductive wall for providing electrical connectivity between the first and second portions;

a first biasing member disposed in the first portion, the first biasing member being adapted to deflect upon a first electrical conductor being inserted into the first portion, and the first biasing member being further adapted to bias the first electrical conductor against the conductive wall; and a second biasing member disposed in the second portion, the second biasing member being adapted to deflect upon a second electrical conductor being inserted into the second portion, and the second biasing member being further adapted to bias the second electrical conductor against the conductive wall to electrically couple the first and the second electrical conductors.

13. The electrical connector of claim 12, wherein the connector assembly further comprises a first connector element and a second connector element, the first and second connector elements being separate from each other, and wherein the first connector element comprises the first biasing member and the second connector element comprises the second biasing member.

14. The electrical connector of claim 13, wherein the first and second connector elements are mirror images of each other.

15. The electrical connector of claim 12, wherein the housing comprises at least two insertion openings, whereby the first biasing member and the second biasing member are each aligned to an insertion opening of the at least two insertion openings for receiving the respective first and second electrical conductors.

16. The electrical connector of claim 12, wherein the housing comprises a tool opening, and wherein the first biasing member and the second biasing member are each adapted to reverse the biasing of the respective electrical conductors against the conductive wall using a tool received through the tool opening.

17. The electrical connector of claim 12, wherein the housing comprises a post coupled to a wall of the housing, wherein the post is capable of coupling the connector assembly to the housing.

18. The electrical connector of claim 12, wherein the housing further comprises a compartment wall to define an interior shape of the housing to substantially correspond to a shape of the connector assembly.

19. A connector for coupling to a conductive wall of a connector assembly, the connector comprising a first connector element and a second connector element adjacent to each other, each connector element of the first and second connector elements including:

a side wall for separating the assembly into a first and a second portion; and a biasing member adjacent to the side wall and disposed in one of the first and second portions, the biasing member being adapted to deflect upon an electrical conductor being inserted into one of the first and second portions, the biasing member being further adapted to bias the electrical conductor against the conductive wall.

20. The connector of claim 19, further comprising a first guide end wall to interact with a guide of the conductive wall to couple the connector element to the conductive wall.

21. The connector of claim 19, further comprising a first opening provided within the side wall, and wherein the connector element is capable of being coupled together to the another separate connector element via the first opening.

22. The connector of claim 19, wherein the biasing member is further adapted to reverse the biasing of the respective electrical conductor against the conductive wall via interaction with a tool.

23. The connector of claim 19, further comprising a first limiting means extending from the side wall for limiting deflection of the biasing member.

24. The connector of claim 19, further comprising a first stopping means extending from the side wall for indicating over-insertion of the respective electrical conductor.

25. The connector of claim 19, wherein the biasing member is adapted to deflect upon contact of the electrical conductor being inserted into at least one of the first and second portion.

26. The connector of claim 19, wherein the another separate connector element is a minor image of the connector element.

27. A method of forming a connector assembly, the method comprising:

providing a conductive wall for providing electrical connectivity;

providing two or more connector elements, each comprising, a side wall;

a biasing member adjacent to the side wall;

forming a support structure wall using two or more adjacent side walls of the two or more connector elements, the support structure wall separating the conductive wall into a first and a second portion;

disposing a first biasing member of a first connector element of the two or more connector elements in the first portion, the first biasing member being adapted to deflect upon a first electrical conductor being inserted into the first portion, the first biasing member being further adapted to bias the first electrical conductor against the conductive wall; and disposing a second biasing member of a second connector element of the two or more connector elements in the second portion, the second biasing member being adapted to deflect upon a second electrical conductor being inserted into the second portion, the second biasing member being further adapted to bias the second electrical conductor against the conductive wall to electrically couple the first and the second electrical conductors.

28. The method as claimed in claim 27, further comprising coupling the two or more connector elements to the conductive wall.

* * * * *